US006725658B1

(12) United States Patent
Lemmen et al.

(10) Patent No.: US 6,725,658 B1
(45) Date of Patent: Apr. 27, 2004

(54) ADJUSTING DEVICE OF A SWASHPLATE PISTON ENGINE

(75) Inventors: Ralf Lemmen, Tuebingen (DE); Roland Belser, Haigerloch (DE); Hermann Maier, Waldachtal (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 20 days.

(21) Appl. No.: 10/110,575

(22) PCT Filed: Sep. 29, 2000

(86) PCT No.: PCT/EP00/09566

§ 371 (c)(1),
(2), (4) Date: Aug. 1, 2002

(87) PCT Pub. No.: WO01/27472

PCT Pub. Date: Apr. 19, 2001

(30) Foreign Application Priority Data

Oct. 12, 1999 (DE) ..... 199 49 169

(51) Int. Cl.[7] ..... F16D 31/02
(52) U.S. Cl. ..... 60/444; 60/443; 91/506
(58) Field of Search ..... 60/443, 444; 91/506

(56) References Cited

U.S. PATENT DOCUMENTS 4,379,389 A 4/1983 Liesener
4,722,186 A 2/1988 Louis et al.
5,881,629 A 3/1999 Gollner et al.

FOREIGN PATENT DOCUMENTS

| | | |
|---|---|---|
| CH | 526 977 | 8/1972 |
| CH | 660 637 A5 | 5/1987 |
| DE | 1 958 768 | 6/1971 |
| DE | 33 46 000 A1 | 6/1984 |
| DE | 34 04 534 A1 | 9/1985 |
| DE | 39 35 800 C2 | 5/1991 |
| DE | 196 53 165 C1 | 4/1998 |
| FR | 1 099 156 | 8/1955 |

*Primary Examiner*—Edward K. Look
*Assistant Examiner*—Michael Leslie
(74) *Attorney, Agent, or Firm*—Scully, Scott, Murphy & Presser

(57) ABSTRACT

An adjusting device (1) for adjusting the swash plate (12) of an axial piston engine (1) with a swash-plate construction has an actuating piston (18) which acts on the swash plate (12) of the axial piston engine (1); and a control value (19). The control valve (19) is used to regulate the actuating pressure which is present in an actuating volume (45) and which is acting on the actuating piston (18), in accordance with a control force acting on a valve piston (20) of the control valve (19). The actuating piston (18) is structurally separate from the control valve (19) and the actuating piston (18) is connected to the valve piston (20) of the control valve (19) by a readjusting spring (34) that opposes the control force.

13 Claims, 3 Drawing Sheets

ADJUSTING DEVICE OF A SWASHPLATE PISTON ENGINE

Figure 1:
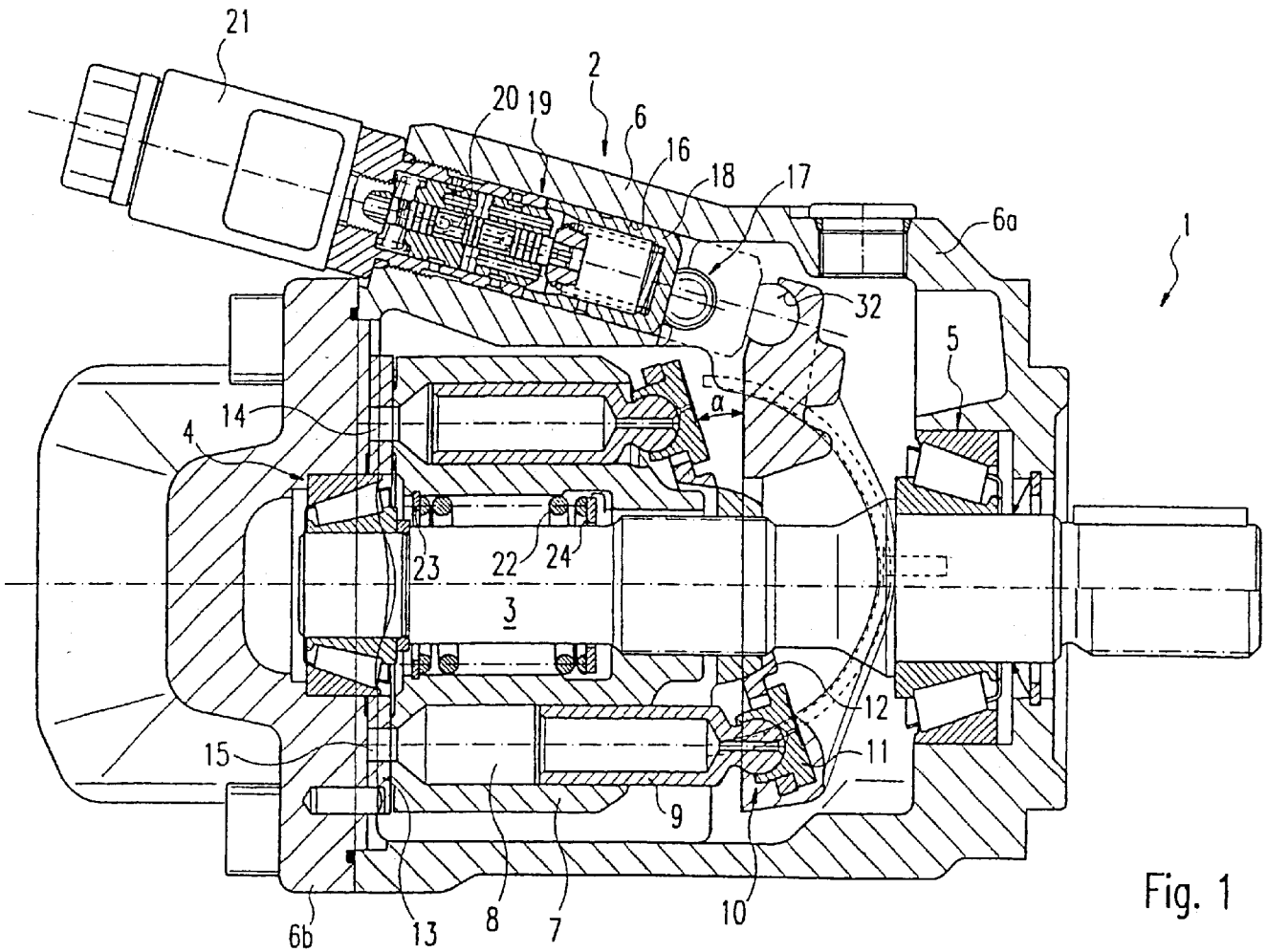

An adjusting device according to the preamble of claim 1 is evident from DE-AS 1 958 768. An adjusting device, with an actuating piston, which at the same time forms the valve housing for a control valve, is shown in FIG. 7 of this patent. A valve piston in its turn is axially movable inside the axially movable valve housing, control pressure being applied to the valve housing at one end. By application of the control pressure the valve piston is axially displaced, so that a first control edge increases the actuating pressure in an actuating volume and in this case the valve housing serving as actuating piston is axially displaced in the same direction, so that the control edge is again closed. The actuator defining the displacement volume of the piston engine is also adjusted by the same distance, by which the valve piston and the valve housing have been axially displaced. When the control pressure reduces, a readjusting spring displaces the actuating piston in the reverse direction and a second control edge connects the actuating volume to a tank connection. As a result the actuating volume is relieved and the valve housing serving as actuating piston is axially displaced in the same direction as the valve piston. The pressure chamber for the control pressure is separated from a gas volume by a flexible dividing wall, so that the control pressure experiences a certain time buffering.

The disadvantage with the known adjusting device is that the valve housing and the valve piston of the control valve can be manufactured with the necessary precision with only limited axial face to face dimension. Since the axial displacement of the actuating piston and the valve housing directly define the adjustment of the actuator of the piston engine, the regulating distance for the actuator is relatively short. Either the swash plate of the axial piston engine can only be adjusted therefore within relatively minimal limits, or a corresponding translation is necessary.

The object of the invention therefore is to provide an adjusting device for adjusting the swash plate of an axial piston engine with a swash plate construction, in which the setting range of the actuating piston is independent of the setting range of the valve piston of the control valve.

The object is achieved by the characteristic features of claim 1 in conjunction with the generic-forming features.

The invention is based on the finding that by structurally separating actuating piston and control valve a relatively wide setting range of the actuating piston can be achieved with a relatively narrow setting range of the valve piston of the control piston. The necessary reaction between the actuating piston and the valve piston of the control valve takes place not as with the present state of the art through positive engagement by the valve housing of the control valve, but through non-positive engagement by a readjusting spring connecting the actuating piston to the valve piston of the control valve. The solution according to the invention permits an extremely compact design, which can be easily integrated in a location hole of the housing of the axial piston engine.

The sub-claims contain further advantageous embodiments of the invention.

In particular it is advantageous to design the adjusting piston with a pot-shape so that the adjusting piston holds the readjusting spring and a plate spring connected to the valve piston of the control valve.

A communicating channel is preferably provided in the stationary valve housing to connect the actuating volume to the control edges of the valve piston. The valve housing can also have a restrictor, in order to connect the communicating channel restricted to the tank connection and to relieve the actuating volume. In addition the valve piston preferably has a through hole, in order to allow the actuating pressure to act on both sides of the valve housing, so that the position of the valve is independent from the actuating pressure.

The valve housing of the control valve is preferably pressed by a pressure spring against an adjustable stop so that the axial position of the valve housing can be adjusted. The stop can for example be formed by an eccentric stud.

The control force acting on the actuating piston of the control valve is preferably produced by a solenoid, in particular a proportional magnet, or an electric motor, in particular a stepping motor. In this case the solenoid or electric motor can engage the valve piston via a tappet at the end opposite to the readjusting spring.

A preferred embodiment example of the invention is described in detail below with reference to the drawings.

Figure 2:
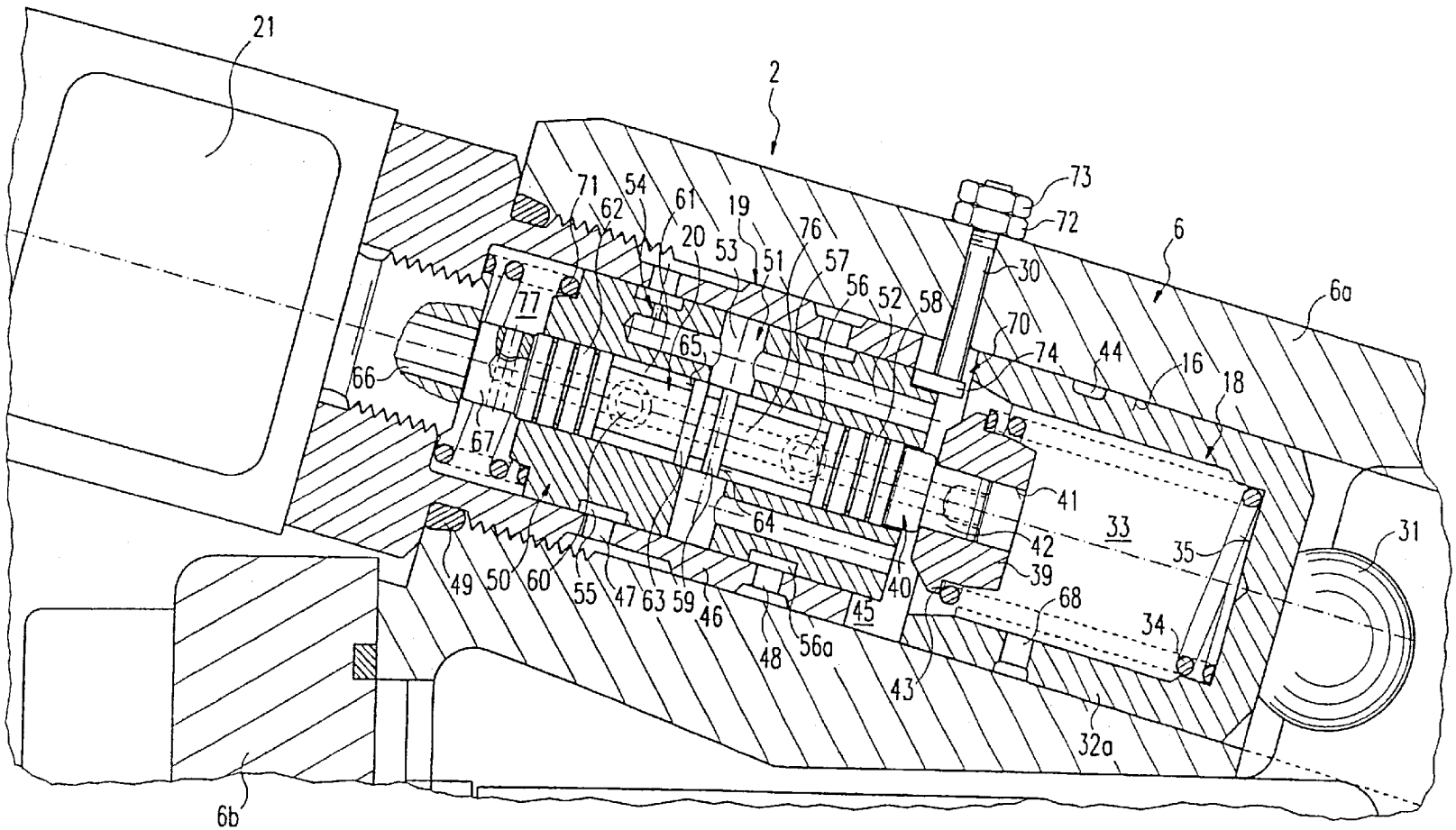
Figure 3:
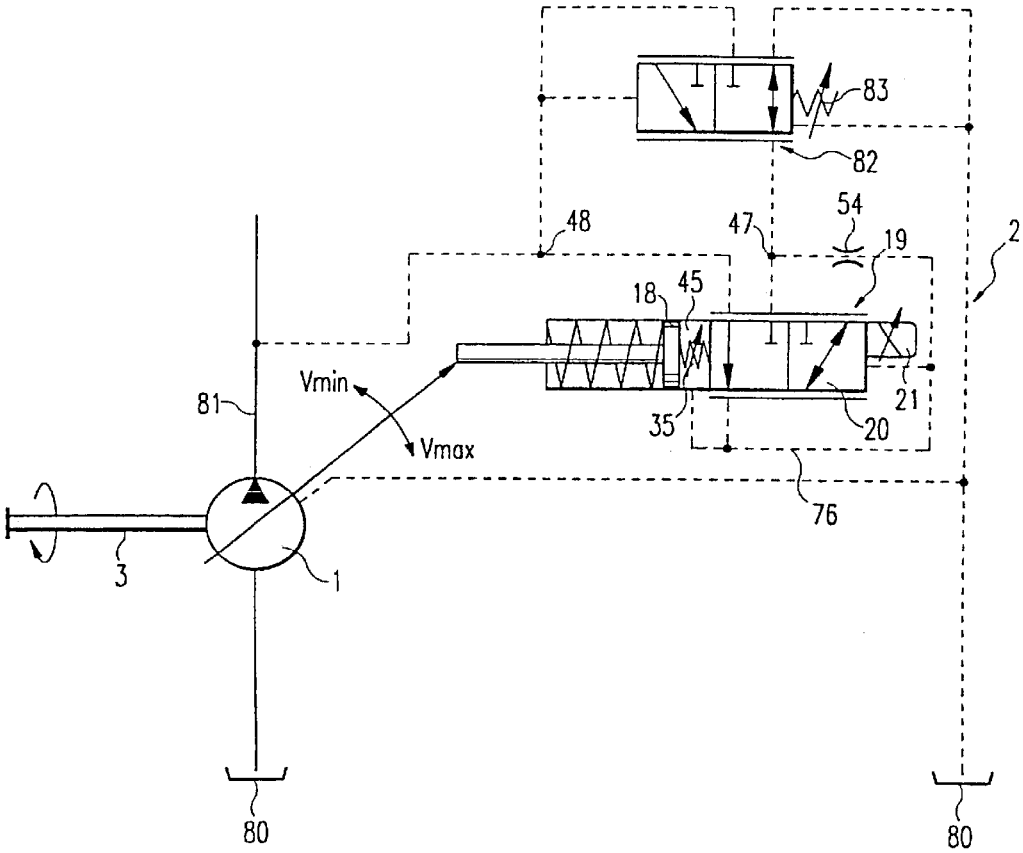

The drawings show:

FIG. 1 a sectional view through an axial piston engine, on which an embodiment of the adjusting device according to the invention is provided;

FIG. 2 an enlarged illustration of the embodiment of the adjusting device according to the invention; and FIG. 3 an hydraulic circuit in principle of the adjusting device according to the invention.

FIG. 1 shows an axial sectional view through an axial piston engine 1 with a swash plate construction, on which an adjusting device 2 according to the invention is provided. The basic structure of an axial piston engine 1 with a swash plate construction is known so that the description below can be limited to the essential component parts.

A shaft 3 is mounted rotatably on a first bearing 4 and on a second bearing 5 in a housing 6 of the axial piston engine 1. The housing 6 of the axial piston engine 1 is split up into a basic body 6*a* and a cover body 6*b* bolted together with the basic body 6*a*.

A cylinder drum 7 is rigidly connected to the shaft 3. In the cylinder drum 7 are located cylinder bores 8 staggered over a reference circle, in which pistons 9 can be axially displaced. The pistons 9 are connected by ball and socket joints 10 with sliding blocks 11 and are supported by the sliding blocks 11 on a swash plate 12 formed as a pivoting cradle. The cylinder bores 8 are connected to a high pressure line, not shown, and a low pressure line, also not shown, via a control body 13, which has a kidney-shaped high-pressure opening 14 and a likewise kidney-shaped low pressure opening 15. The stroke of the pistons 9 in the cylinder bores 8 is defined by the pivoting angle $\alpha$ of the swash plate 12. The swash plate designed as pivoting cradle is shown twice in FIG. 1, once in its neutral position and once in a position pivoted around the pivoting angle $\alpha$.

The cylinder drum 7 is held in position on the control body 13 by means of a spring 22. For this purpose the spring 22 is supported on the cylinder drum 7 by a first ring 23 and on the shaft 3 by a second ring 24. The cylinder drum 7 is axially movable in contrast to the stationary shaft 3 through a wedge-groove connection.

The adjusting device 2 according to the invention serves to pivot the swash plate 12. The adjusting device 2 is integrated in a location hole 16 of the housing 6 and consists of an actuating piston 18, which is axially guided in the location hole 16, connected to the swash plate 12 by the ball joint 17, a control valve 19 inserted into the location hole 16 and an actuator 21 defining a control force for a valve piston 20 of the control valve 19. The control valve 19 and the actuating piston are axially staggered to each other in the location hole 16.

An embodiment of the adjusting device 2 according to the invention is shown enlarged in FIG. 2. The embodiment is essentially the same as the embodiment shown in FIG. 1, with the difference that in the embodiment shown in FIG. 2 an adjustment screw 30 is provided, the function of which will be discussed in detail. Moreover elements agreeing with FIG. 1 are given the same reference, in order to make association of these easier.

A spherical slide ring 31 slides on the actuating piston 18 axially guided in the location hole 16 of the housing 6, which together with a spherical cavity of the swash plate 12 shown in FIG. 1 forms the ball joint 17. Naturally vice versa the slide ring 31 could also slide on the swash plate 12 and the spherical cavity could be formed in the actuating piston 18. The actuating piston 18 is pot-shaped so that its wall 32 surrounds a cavity 33, which holds a readjusting spring 34 for the valve piston 20 of the control valve 19 still to be described in detail later. The readjusting spring 34 is clamped between the base 35 of the pot-shaped actuating piston 18 and a spring plate 39, which is connected to a first end 40 of the valve piston 20 of the control valve 19. The spring plate 39 comprises an axial longitudinal hole 41, which is placed on a pin-shaped projection 42 of the valve piston 20. The readjusting spring 35 is supported on an outside step 43 of the spring plate 39. An outside ring groove 44, which is connected by a radial channel 68 to the cavity 33, is provided to lubricate the sliding face of the actuating piston 32. The ring groove 44 also serves as an hydraulic stop. The diameter of the cavity 33 is greater than the diameter of the spring plate 39, so that the spring plate 39 in the maximum pivot position shown in FIG. 2 enters the cavity 33 of the actuating piston 18.

An actuating pressure defined by the actuator 21 via the control valve 19 builds up in the actuating volume 45, which encloses the cavity 33 of the actuating piston 18. The higher the actuating pressure in the actuating volume 44, the further the actuating piston 18 in FIG. 2 is displaced to the right and pivots the swash plate 12 in the direction of decremental displacement volume of the axial piston engine 1. The less the actuating pressure in the actuating volume 45, the further the actuating piston 18 in FIG. 2 pivots to the left in the direction of incremental displacement volume of the axial piston engine 1.

The control valve 19 consists of a permanent, sleeve-shaped connection body 46, in which a tank connection 47 and a delivery connection 48 are provided. The connection body 46 is sealed from the housing 6 by a gasket 49, for example an O-ring. Inside the connection body 46 is located a valve housing 50, in which the valve piston 20 is axially displaceable. The valve piston 20, the valve housing 50, the connection body 46 and the location hole 16 of the housing 6, in which the control valve 19 is inserted, are aligned coaxially with each other.

In the valve housing 50 is located a communicating channel 51, in the embodiment consisting of a longitudinal hole 52 formed as pocket hole and a lateral hole 53. The communicating channel 51 is connected via a restrictor 54 to the tank connection 47. In the vicinity of the tank connection 47 the valve housing 50 comprises a first ring channel 55, while the valve housing 50 in the vicinity of the delivery connection 48 comprises a second ring channel 56.

The valve piston 20 comprises a first annulus 57 connected to the delivery connection 48 through a first radial hole 56, which is sealed by an impervious section 58 and a radial projection 59 of the valve piston 20. In addition the valve piston 20 comprises an annulus 61 communicating through a second radial hole 60 with the tank connection 47, which is sealed by an impervious section 62 and a radial projection 63 of the valve piston 20. In this case a first control edge 64 is formed on the transition from the first annulus 57 to the projection 59, while a second control edge 65 is formed on the transition from the second annulus 51 to the projection 63. The actuator 21 exerts a control force on the second end 67 of the actuating piston 20 opposite to the readjusting spring 34 via a tappet 66.

The mode of operation of the adjusting device 2 according to the invention is as follows:

Whenever hydraulic pressure is applied to the delivery connection 48 and the actuator 21 does not exert any control force on the actuating piston 20 so that the valve piston 20 is in its basic position shown in FIG. 2, the first control edge 64 opens the connection between the delivery connection 48 and the communicating channel 51. Therefore an actuating pressure builds up in the actuating volume 45, which displaces the actuating piston 18 in FIG. 2 to the right in the direction of minimum displacement volume or neutral position.

Whenever the actuator 21 exerts a control force on the valve piston 20, which displaces the valve piston 20 in FIG. 2 to the right, the first control edge 64 is closed and the second control edge 65 connects the tank connection 47 through the communicating channel 51 to the actuating volume 45. The actuating volume is therefore relieved through the tank connection 47 and the actuating pressure drops. As a result the actuating piston 18 in FIG. 2 is displaced to the left and the swash plate 12 pivots in the direction of greater displacement volume of the axial piston engine. At the same time the readjusting spring 34 is tensioned by the movement of the actuating piston 18 and there arises a counter force that opposes the control force of the actuator 21, which with increasing displacement of the control piston 18 in FIG. 2 increases to the left. When such an equilibrium point is reached so that the control force exerted by the actuator 21 corresponds to the counter force exerted by the readjusting spring 34, the valve piston 20 is at its equilibrium point, so that neither the control edge 64 nor the control edge 65 opens and a constant actuating pressure builds up in the actuating volume 45. The hydraulic fluid escapes slowly from the actuating volume 45 through the restrictor 54. The escaping hydraulic fluid is continually followed by slight displacement of the actuating piston 20 via the control edge 64.

Whenever the control force exerted by the actuator 21 on the actuating piston 20 increases or decreases, a new equilibrium point results, in each case the control force exerted by the actuator 21 corresponding to the counter force exerted by the readjusting spring 34. The counter force of the readjusting spring 34 is proportional to the position of the actuating piston 18. Therefore any control force defined by the actuator 21 corresponds to a defined position of the actuating piston 18 and therefore to a defined pivoting angle $\alpha$ of the swash plate 12.

A solenoid is especially suitable as an actuator 21, in particular a proportional magnet, the force or excursion of which is proportional to the excitation current. However an electric motor is also particularly suitable as an actuator 21, in particular a stepping motor, which for example transfers a control force proportional to the turning position of the electric motor via a spindle and a spring on the tappet 66 disposed between the tappet 66 and the spindle. The control force exerted on the end 47 of the actuating piston 20 can however also be an hydraulic force, which is present in a pressure chamber formed at the end 67 of the valve piston 20 and acts on the left face of the valve piston 20 in FIG. 2.

In order to be able to adjust the valve housing 50 and therefore the characteristic of the control valve within certain limits in the case of the embodiment shown in FIG. 2 an adjustable stop 70 is provided, a pressure spring 71 holding the valve housing 50 in position on the adjustable stop 70. Due to the adjustable stop 70 the relative position of the control edges 64 and 65 can be adjusted in relation to the lateral hole 53 of the communicating channel 51. In the embodiment illustrated the adjustable stop 70 consists of an adjustment screw 30 screwed in the housing 6 with bolt head 72 and counter nut 73. On the end of the adjustment screw 30 penetrating the location hole 16 is located a disk 74 mounted eccentrically. The stop position, which is struck by the face 75 of the valve housing 50, can be varied by turning the adjustment screw 30 so that the axial position of the valve housing 50 can be changed.

In the valve piston 20 in the embodiment illustrated is located a through channel 76, connecting the actuating volume 45 to the spring chamber 77, which holds the pressure spring 71. Therefore in FIG. 2 the same pressure is present left of the valve housing 50 as right of the valve housing 50 and the actuating pressure present in the actuating volume 45 has no influence over the axial position of the valve housing 50.

For better understanding of the invention an hydraulic circuit of the adjusting device 2 according to the invention is shown in principle in FIG. 3. Elements already described are also given the same reference here.

The axial piston engine 1 operating in the embodiment as a hydraulic pump is driven by the shaft 3, sucking hydraulic fluid from a tank 80 and pumping the hydraulic fluid into a working line 81. The working line 81 is connected to the delivery connection 48 of the adjusting device 2. On the other hand the tank connection 47 of the adjusting device 2 is connected through a pressure limiting valve 82 either to the tank 80 or to the working line 81. In the basic position of the pressure limiting valve 82 shown in FIG. 3 the pressure limiting valve 82 of the tank connection 47 connects to the tank 80.

Also recognisable are the actuating piston 18, the control valve 19 with the valve piston 20, the readjusting spring 35 disposed between the actuating piston 18 and the valve piston 20 and the actuator 21 designed in the embodiment as a proportional magnet. It is also clear that the volumes left and right of the valve piston 20 are connected to each other via the through channel 76.

In the case of the embodiment shown in FIG. 3 the pressure limiting valve 82 serves to limit the maximum pressure in the working line 81. If pressure present in the working line 81 exceeds the maximum pressure which can be adjusted by means of the spring 83, the pressure limiting valve 82 connects the tank connection 47 to the working line 81, instead of to the tank 80, so that the actuating volume 45 is not relieved by the tank 80, but has the operating pressure present in the working line 81 applied to it. The axial piston engine 1 is therefore pivoted back by the actuating piston 18 in the direction of the minimum displacement volume Vmin or in the direction of the neutral position. In FIG. 3 the maximum displacement volume is identified by Vmax which occurs whenever the actuating piston 18 in FIG. 2 strikes its left stop.

The invention is not limited to the embodiments shown, but can also be used with an adjusting device 2 in other designs or with axial piston engines 1 of another construction. It should be emphasised that the setting range of the actuating piston 18 is independent of the setting range of the valve piston 20 and despite only a very slight adjustment of the valve piston 20 a very wide setting range of the actuating piston 18 can be achieved. Therefore it is not necessary to translate the setting range of the actuating piston 18.

What is claimed is:

1. An adjusting device (1) for adjusting the swash plate (12) of an axial piston engine (1) in a swash plate construction, including an actuating piston (18) engaging the swash plate (21) of the axial piston engine (1) and a control valve (19) for regulating the actuating pressure present in an actuating volume (45) and acting on the actuating piston (18) in accordance with a control force acting on a valve piston (20) of the control valve (19), said actuating piston (18) being structurally separate from the control valve (19), wherein the actuating piston (18) is connected to the valve piston (20) of the control valve (19) by a readjusting spring (34) acting against the control force, the actuating piston (18) and the control valve (19) being insertable into a location hole (16) of a housing (6) of the axial piston engine (1) axially staggered with respect to each other, said valve piston (20) of the control valve (19) being movable within a valve housing (50), and the valve piston (20) has a through channel (76) connected with the actuating volume (45), so that the actuating pressure is applied to both sides of the valve housing (50), whereby the position of the valve housing (50) is independent of the actuating pressure and the position of the swash plate (12).

2. An adjusting device (1) for adjusting the swash plate (12) of an axial piston engine (1) in a swash plate construction, including an actuating piston (18) engaging the swash plate (21) of the axial piston engine (1) and a control valve (19) for regulating the actuating pressure present in an actuating volume (45) and acting on the actuating piston (18) in accordance with a control force acting on a valve piston (20) of the control valve (19), said actuating piston (18) being structurally separate from the control valve (19), wherein the actuating piston (18) is connected to the valve piston (20) of the control valve (19) by a readjusting spring (34) acting against the control force, the actuating piston (18) and the control valve (19) being insertable into a location hole (16) of a housing (6) of the axial piston engine (1) axially staggered with respect to each other, said valve piston (20) of the control valve (19) being movable within a valve housing (50), and said valve housing (50) being pressed by a pressure spring (71) against an adjustable stop (70), whereby the axial position of the valve housing (50) is adjustable by the adjustable stop (70).

3. Adjusting device according to claim 1 or 2, wherein the pretension of the readjusting spring (34) is dependent on the position of the actuating piston (18).

4. Adjusting device according to claim 1 or 2, wherein said actuating piston (18) is pot-shaped, and the readjusting spring (34) is integrated in a cavity (33) of the pot-shaped actuating piston (18).

5. Adjusting device according to claim 4, wherein the cavity (33) of the actuating piston (18) holds a spring plate (39) which is connected to the valve piston (20), the readjusting spring (34) being clamped between the base (35) of the pot-shaped actuating piston (18) and the spring plate (39).

6. Adjusting device according to claim 1 or 2, wherein the valve housing (50) has a communicating channel (51) communicating with the actuating volume (45) and the valve piston (20) has a first control edge (64) which connects the communicating channel (51) with a delivery connection (48), and a second control edge (65) which connects the communicating channel (51) with a tank connection (47).

7. Adjusting device according to claim 6, wherein the valve housing (50) includes a restrictor (54) for restrictedly connecting the communicating channel (51) with the tank connection (47).

8. Adjusting device according to claim 1 or 2, wherein the control force is produced by a solenoid (21).

9. Adjusting device according to claim 1 or 2, wherein the control force is produced by an electric motor.

10. Adjusting device according to claim 8, wherein the solenoid (21) is connected to the valve piston (20) by a tappet (66) which engages the valve piston (20) at an end (67) opposite to the readjusting spring (34).

11. Adjusting device according to claim 9, wherein the electric motor is connected to the valve piston (20) by a tappet (66) which engages the valve piston at an end opposite to the readjusting spring (34).

12. Adjusting device according to claim 8, wherein the solenoid (21) is a proportional magnet.

13. Adjusting device according to claim 9, wherein the electric motor is a stepping motor.

* * * * *